US006571715B1

(12) United States Patent
Bennett et al.

(10) Patent No.: US 6,571,715 B1
(45) Date of Patent: Jun. 3, 2003

(54) BOOT MECHANISM FOR COMPLEX PROJECTILE BASE SURVIVAL

(75) Inventors: Stephen E. Bennett, Tucson, AZ (US); Chris E. Geswender, Tucson, AZ (US); Kevin R. Greenwood, Tucson, AZ (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 10/095,208

(22) Filed: Mar. 11, 2002

(51) Int. Cl.[7] ..... F42B 39/30
(52) U.S. Cl. ..... 102/439; 102/374; 244/3.27
(58) Field of Search ..... 102/439, 374, 102/372; 244/3.24, 3.27, 3.28, 3.29

(56) References Cited

U.S. PATENT DOCUMENTS 2,271,280 A * 1/1942 Weinert
4,209,146 A * 6/1980 Mattson
4,860,969 A * 8/1989 Muller et al.
5,114,095 A * 5/1992 Schroppel et al.
5,325,787 A * 7/1994 Boual
6,308,734 B1 * 10/2001 Smith et al.
6,454,205 B2 * 9/2002 Niemeyer et al.

FOREIGN PATENT DOCUMENTS

GB 737348 * 9/1995 ..... 102/372

* cited by examiner

*Primary Examiner*—Tien Dinh
(74) *Attorney, Agent, or Firm*—Renner, Otto, Boisselle & Sklar, LLP

(57) ABSTRACT

A projectile (10) with extensible fins (24) is designed to be lightweight by removing material unnecessary to structural strength and filling the resulting voids with a non-metallic filler material (26). Although particularly suited where the extensible fins (24) are mounted behind the obturator (22) and that are therefore subjected to turbulent, destructive shock waves when the projectile is accelerated down the gun barrel, the method and apparatus can be used elsewhere as well. The filler material (26) may be high temperature grease, an epoxy, a silicone or other similar materials. The filler material (26) may be designed to fall away as soon as the projectile (10) exits the gun barrel, or it may be permanently adhered to the material of the projectile. The filler may be surrounded by a frangible boot (66, 66') to protect the filler during storage, shipment and loading into the gun.

16 Claims, 4 Drawing Sheets

BOOT MECHANISM FOR COMPLEX PROJECTILE BASE SURVIVAL

FIELD OF THE INVENTION

The present invention relates to projectiles and particularly to an apparatus and method to protect extensible fins mounted in the rear portion of a projectile as the projectile is fired from a gun.

BACKGROUND OF THE INVENTION

An aim of projectile design is to deliver a payload farther from the gun that fires it. This goal of longer range can be met by reducing the weight of the projectile and by increasing the size of the charge used to propel it. These two factors are not independent of one another, and increasing the propellant charge may damage the projectile because of increased gas pressure in the firing chamber and barrel. Reducing the weight may reduce the strength of the projectile to sustain the increased charge and may also reduce the apogee of the ballistic flight path, thereby reducing the range.

Projectiles have had control surfaces such as fins that fold inward to fit inside the projectile when it is fired from a gun and then fold outward once the projectile has cleared the gun barrel. Smaller fins create less drag and so allow a longer range. However, the fins must provide enough surface area to control the projectile in its flight. The required fin size can be reduced by minimizing the aftward mass of the projectile, shifting its center of gravity forward.

Past attempts at reducing the weight at the tail or aft end of a projectile by removing material from around the folded-in fins have resulted in a desirable weight reduction, but the exposed fins have been unable to withstand the concussion of being fired from a gun, especially as the charge used has been increased to increase range.

In the past, projectile fins have been mounted by a pivot pin to bosses that extend outward from the base of the projectile. Because the pressure retaining obturator has been mounted in front of the fins, the fins in their folded-in positions have been exposed to destructive pressure forces from the charge that fires the projectile.

Accordingly, there is a need for a projectile with fins pivotably mounted and able to survive the shock of being fired from a gun and that is also free of unnecessary mass at its aft end.

SUMMARY OF THE INVENTION

The present invention provides a projectile (or round) that has reduced weight in its aft end and has retractably mounted fins that are packaged to survive the shock of being shot from a gun.

A projectile utilizing the present invention has a base that forms the rearmost portion of the round. The base supports the fins and in some projectiles may form a nozzle for directing rocket exhaust to propel the projectile. An obturator is located at the front end of the base, in front of the fins.

We have discovered that the pressures inside a gun barrel behind the obturator when the charge is fired are not isostatic, but rather dynamic and turbulent. Resonances may occur in open volumes, and such resonances may cause destructive pressure waves to course through these spaces as the charge is ignited and the projectile accelerates through the barrel. The present invention limits the development of such destructive pressures while allowing a light-weight base. This is accomplished first by reducing the weight of the base as much as possible and then filling any voids in the base with an incompressible material that is lighter in weight than the metal it replaces.

The present invention may be carried into practice using a light-weight, non-metallic, substantially incompressible filler material to surround and support the fins while the projectile is in the barrel. Once clear of the barrel, the filler material may fall away, allowing the fins to extend so as to guide the projectile.

The invention may be carried out with or without using a separable, frangible sleeve or boot that surrounds the aft portion of the projectile. If such a boot is used, the volume it encloses, including the cavities housing the in-folded fins and other cavities within the boot, is filled with a filler of the kind described. The filler material may be any of a variety of materials that meet the performance specifications including high temperature grease, GE's RTV, a wax material or any other substantially incompressible material. For ease of installation, the filler material should be flowable and, if intended, it should break away cleanly and completely from the base of the projectile. The material may also be similar in all respects to the above, but remain completely in place. With this sort of material the base may be designed as a composite structure, with the filler material bonded to the metal of the base to provide a light weight yet structurally strong base. In addition, combinations of the two types of fillers (fall away and permanently adhered) may be used.

As the projectile emerges from the barrel, the boot, if used, falls away. If the filler is designed to fall away, it too falls away. If the filler is designed to remain, then it does so. The result is that the fins are protected from concussive resonances during the first moments of acceleration as the charge speeds the projectile down the barrel.

The fins are mounted to the base of the projectile. The use of a nonmetallic, incompressible filler material allows the base to be designed to be as light-weight as possible consistent with providing the necessary strength. This results in a base with fin mounting bosses that also has many hollowed out cavities where metal not necessary for strength purposes has been removed. These cavities and the spaces around the outside of the projectile and within the envelope of its outside cylindrical shape are filled with one or more of the filler materials described above. Because the filler eliminates any voids or cavities where resonances could occur, the base of the projectile is not subjected to destructive pressure waves.

BRIEF DESCRIPTION OF THE DRAWINGS

These and other features and advantages of the present invention will become clear to those skilled in the art from the following description of preferred embodiments when taken together with the accompanying Figures in which.

DESCRIPTION OF PREFERRED EMBODIMENTS

Figure 1:
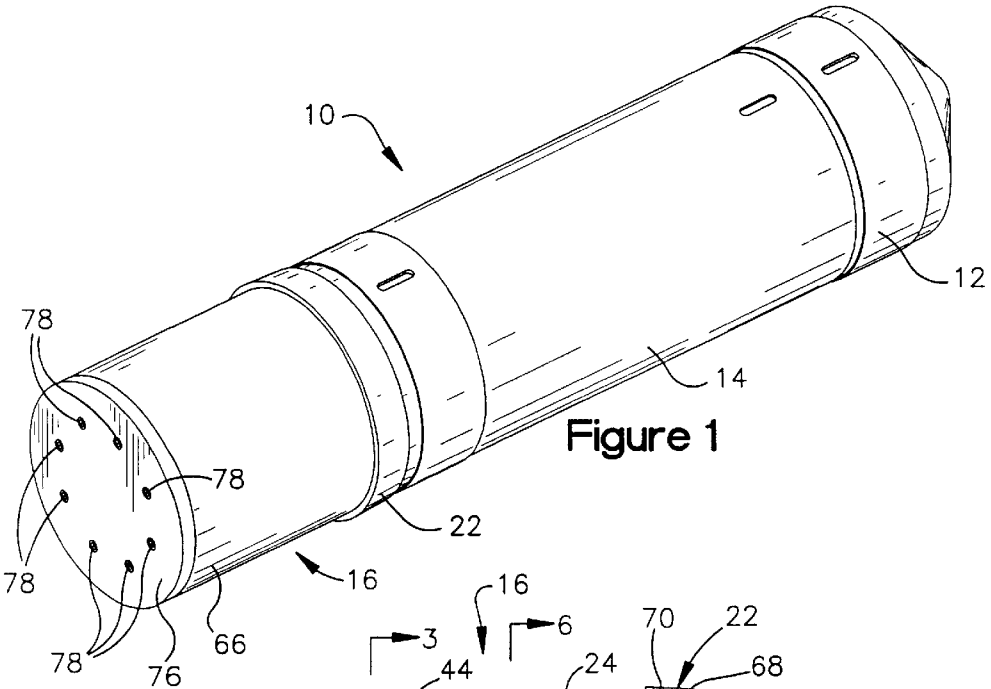
FIG. 1 is a perspective illustration of a projectile having a reduced weight base, a boot surrounding the base and a filler material between the inside of the boot and the base as well as in voids within the base.

The projectile 10 illustrated in FIG. 1 is representative of projectiles that may benefit from use of the present invention. The projectile 10 is suitable for use, for example, in a 155 mm gun. The projectile 10 has a nose 12 that may carry guidance systems as well as the payload to be delivered. The body 14 of the projectile 10 may include fuel that burns to propel the projectile to its intended target. As loaded into a gun the base 16 of the projectile 10 includes an outwardly tapering nozzle 18 (FIG. 2) and an igniter 20 located in the nozzle. When the igniter 20 is activated after leaving the gun barrel, it incinerates itself to ignite the fuel in the body, which then bums, forcing exhaust gasses through the nozzle 18 to propel the projectile 10. Although shown and described in connection with a projectile 10 that has a nozzle 18 and therefore a rocket motor, it will be appreciated that the present invention is equally applicable to projectiles that do not have a nozzle 18 or a rocket motor.

An obturator 22 (FIGS. 1 and 2) is located at the forward end of the base 16. Fins 24 are mounted for pivoting movement at the rear of the base 16, with their free ends just behind the obturator 22. Accordingly, all of the base 16 including the fins 24 mounted to it, is subject to the concussive pressures generated by the charge (not shown) used to drive the projectile 10 out of the gun barrel.

Although the present invention has particular application to that part of a projectile behind the obturator and so exposed to high, turbulent pressures as the charge is set off, it may find use in other locations where components must be protected temporarily from vibration or shock. Therefore, as used in the claims and specification of this application, the term base includes not only structures such as that shown in the Figures but also any other structure supporting or surrounding components that are to be temporarily protected from shock and vibration.

Figure 6:
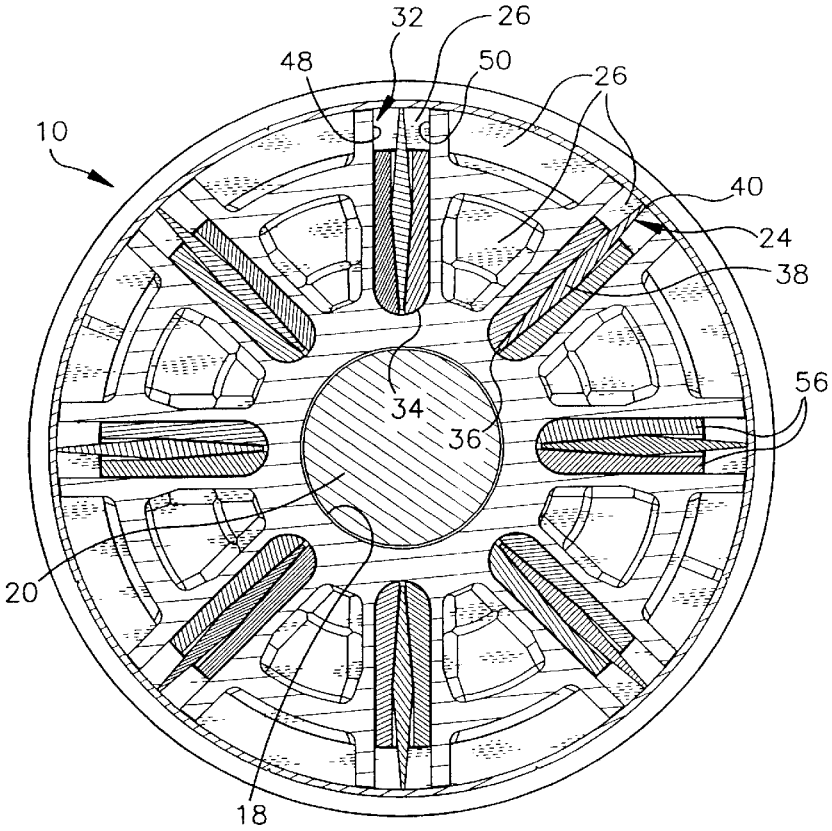
FIG. 6 is a cross sectional view looking in the direction of arrows 6—6 in FIG. 2 and showing the base, fins, fin inserts, and filler material.

All the space in the base 16, not otherwise occupied, is filled with a substantially incompressible material 26 (FIG. 6). This reduces or eliminates entirely empty chambers that can generate destructive transient pressure waves.

The base 16 is generally circular (FIGS. 1, 2 and 3) and is machined from a solid billet of metal, preferably titanium or an alloy of titanium. The base 10 can also be machined from a casting to further minimize weight and expense. The base (FIG. 2) has a central opening 28 that includes the nozzle 18. A passage 30 leads from the upstream end of the nozzle 18 to a propellant supply in the body 14 of the projectile 10. The nozzle 18 is a conical passage opening at the rear to direct the burning propellant gases. Before firing the projectile an igniter fuse 20 fills the nozzle cavity.

The base 16 has eight-fold symmetry, and the various parts of the base and related components are identified with reference numerals where they appear most clearly in the Figures. Not every identical component is identified with a reference numeral in order to leave the Figures clear of excess reference numerals. The base 16 (FIGS. 5 and 6) includes eight fin slots 32 each having a closed bottom 34 (FIG. 6) extending parallel to the axis of the nozzle. The fins 24, the slots 32 they are held in, and their mountings are all alike and only one is described in detail.

Figure 4:
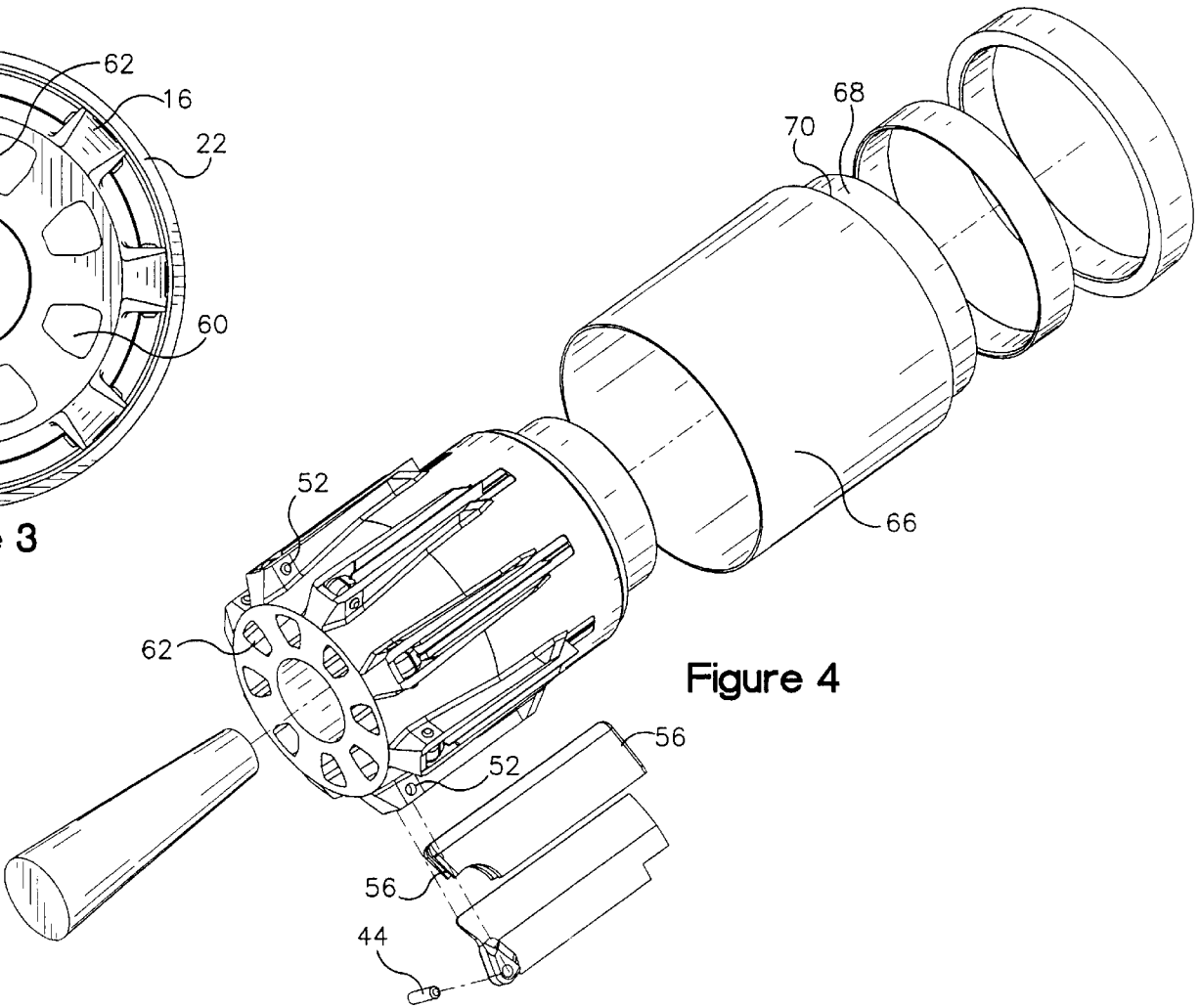
FIG. 4 is an exploded view of the aft end components of the projectile of FIG. 1 with the filler material omitted.
Figure 5:
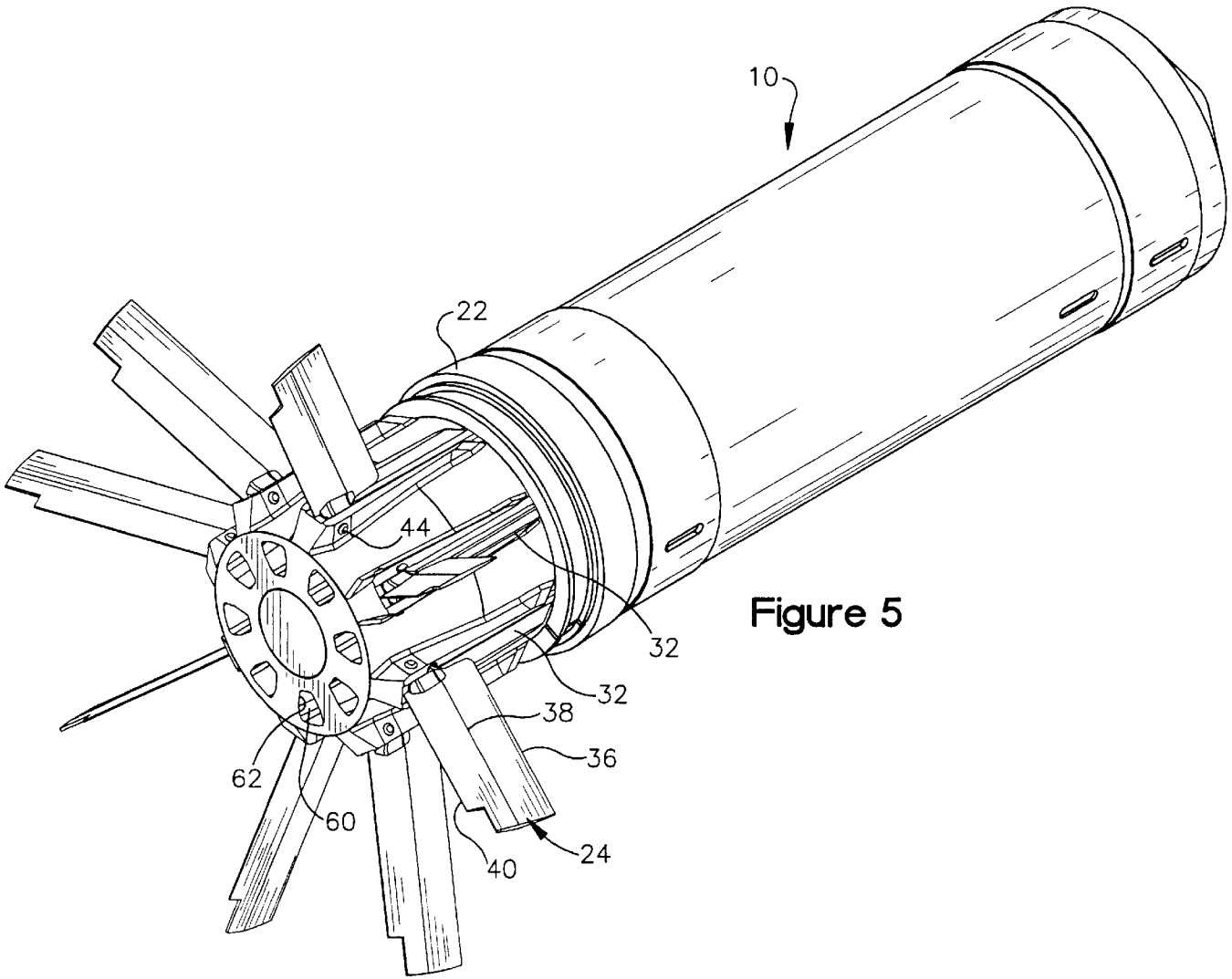
FIG. 5 is a perspective illustration of the projectile of FIG. 1 showing its fins in the extended position.

The fin 24 has an aerodynamic shape that tapers from a narrow leading edge 36 to a broader midsection 38 and then tapers down to a narrow trailing edge 40. During loading and while the round 10 is in the barrel of the gun, the leading edge 36 of the fin 24 is folded inward and is close to the bottom 34 of its slot 32. The slot 32 extends from outside of the base radially inward toward (but not meeting) the nozzle 18. The fin 24 is rotatably mounted on a pin 44 (FIGS. 2, 4 and 5) that extends across the aft end of the slot 32. When ready for firing, the fin 24 is folded inward as shown in FIG. 1. As soon as the round exits the barrel, the fin 24 folds out as shown in FIG. 5.

Support walls 48, 50 (FIG. 6) form each side of the slot 32. Coaxial bores 52 (FIG. 4) through support walls 48, 50 receive and hold the pin 44 about which the fin 24 pivots. As illustrated in FIGS. 4 and 6, inserts 56 may be placed on each side of the fin 24. The fin inserts 56 complement the tapers of the fin 24 and help fill the space between the fin and the inside walls 48, 50 of the slot 32.

As the round 10 emerges from the end of the barrel, gas pressure is released from around the outside of the fins almost instantaneously as the obturator 22 clears the end of the barrel. However some pressure that was acting behind the fins and fin inserts takes a moment longer, and during that moment the pressure difference drives the fins 24 and fin inserts 56 outward, whereupon aerodynamic drag forces the fins to their fully extended position. The fin inserts 56 help to capture and use this momentary pressure difference. However they are not necessary to practicing the invention as it has been found that the drag on the fins 24 alone is enough to open them, or mechanical means such as springs may be used to push the fins out far enough that the drag can take over and move them to their fully extended position. Although the present invention is described in connection with aft deploying fins 24, the fins may also be mounted to pivot about a pin at the forward end of the slot 32, in which case an actuating mechanism must be provided to fold them outward.

The base 16 also includes axially extending, closed cavities 60. (FIG. 3) These cavities are formed between each pair of pin receiving slots to reduce the weight of the base. The cavities are closed or blind in that there is only a single opening 62 into each. Indeed, the entire base 16 is made with the thinnest sections possible consistent with reliable operation of the projectile, and the cavities 60 are formed to eliminate unnecessary metal.

As noted the entire volume inside the gun barrel and behind the obturator 22 is pressurized when the charge is set off to launch the projectile 10. Upon firing, the pressures in this space rise rapidly to approximately 50 kpsi, and the volumes between the fins 24 and within the base 16, would resonate as the shock waves compress the air within if they were left empty. These resonances have proven destructive of the fins 24 and the base 16 itself. To prevent this from happening, the spaces within the base and surrounding the fins are filled with a lightweight, incompressible filler material 26 (FIG. 6). Preferably all of such spaces are filled, but on some designs some cavities may not resonate in a way that is harmful and so need not be filled.

Any of a range of filler materials may be used satisfactorily, so long as they are environmentally safe, non-corrosive, not destructive of surrounding materials, and stable under a wide variety of shipping and storage conditions for as long as 20 years or more. While no material is completely incompressible, it is important that the filler be free of significant change in volume from sub-atmospheric pressures up to about 50 kpsi. Some filler materials may be chosen that will adhere permanently to fill the cavities 60 and the spaces between the fins 24. These filler materials may be permanently bonded to the surfaces of the cavities 60 and may contribute to the structural strength of the base 16. Such filler materials may include epoxies, fiber reinforced epoxies, or other adhering compounds.

Other fillers may be used that are intended to separate from the projectile as soon as it exits the barrel. Suitable materials may include high-temperature grease such as Kendall Super Blu High Temp E. P. L-427 grease, wax, epoxies, or General Electric's RTV.

It is important that whatever filler is used, it operates as intended and that it either adhere completely or separate completely. The projectile 10 may become unbalanced and so uncontrollable if some part of the filler material remains while another part of the filler material separates.

A sleeve called a boot 66 (FIGS. 1, 2 and 6) may also be used in carrying out the invention. The boot 66 completely surrounds the base 16, extending axially from the plane of the outlet of the nozzle 18 forward as far as the forward edge of the obturator 22. To accommodate the obturator 22, the boot 66 is formed with a reduced diameter portion 68 and a shoulder 70. The obturator 22, which is of conventional design, fits around the reduced diameter portion 68 of the boot, and its trailing face rests against the shoulder 70. The leading face of the obturator 22 is pressed against the rear face 72 of the body 14 of the projectile when the base 16 is fastened to the body 14.

The boot 66 may be used with certain types of filler materials 24, especially those, such as grease, that are not self-supporting. The boot 66 supports the filler material 26 and protects it against becoming dislodged during shipment, storage, or loading into the gun breach. With other filler materials 66, such as hard waxes or some epoxies, no boot may be required. If storage, shipping and handling are not a concern, then the boot may prove unnecessary, even with semi-solid fillers such as grease.

Figure 7:
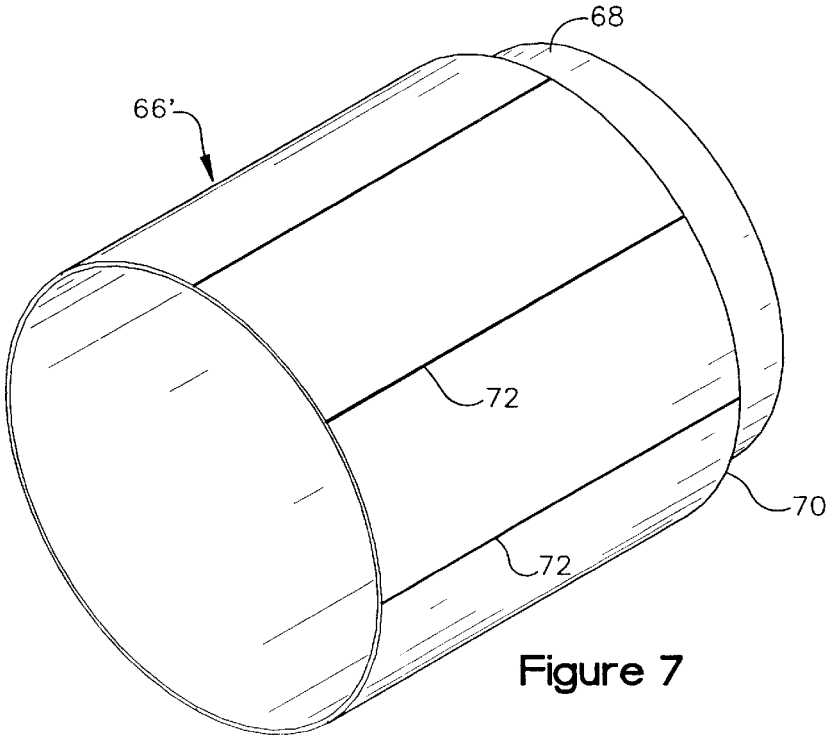
FIG. 7 is an illustration of an alternative boot that may be used with the present invention.

The boot 66 is frangible designed to self-destruct upon exiting the barrel. This can be accomplished in any manner, but it has proven workable to take advantage of the pressure generated by the charge to begin the destruction process. In one embodiment, the walls of the boot 66 are thin enough that hoop stresses upon leaving the barrel are so large that the boot 66 ruptures. In another embodiment (FIG. 7), the boot $\mathbf{66}^1$ has multiple axial grooves 74 equally spaced about the boot and extending from the rear of the boot 66 up to the shoulder 70. The grooves 74 are proportioned so that once the charge is ignited in the gun breach, the boot 66 is crushed while still inside the barrel. The boot 66 then falls away immediately upon exiting the barrel.

Figure 2:
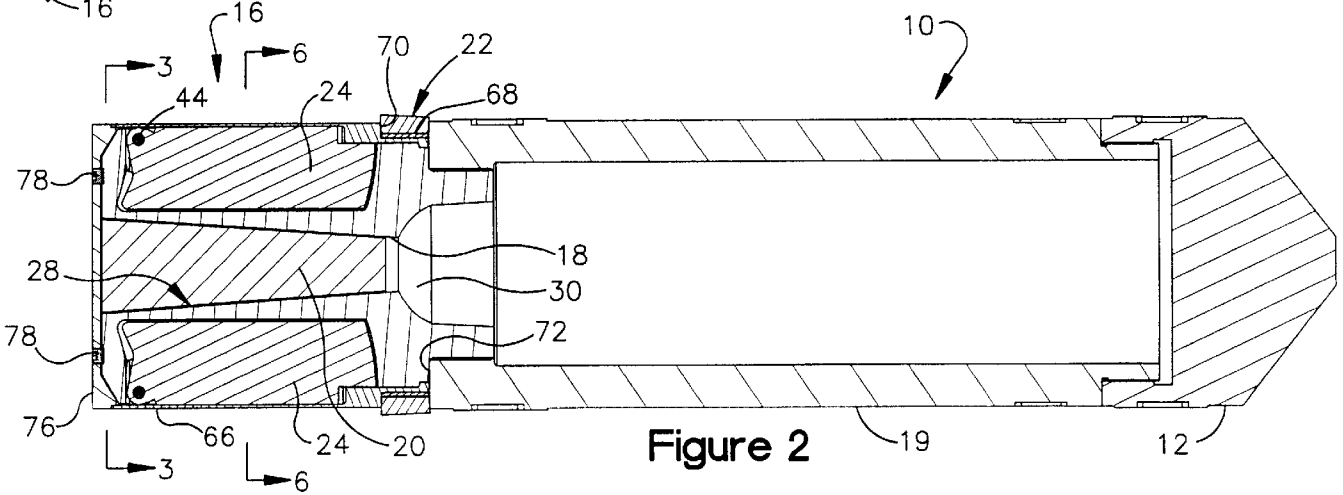
FIG. 2 is a vertical cross-section view through the projectile of FIG. 1 with the filler material omitted.
Figure 3:
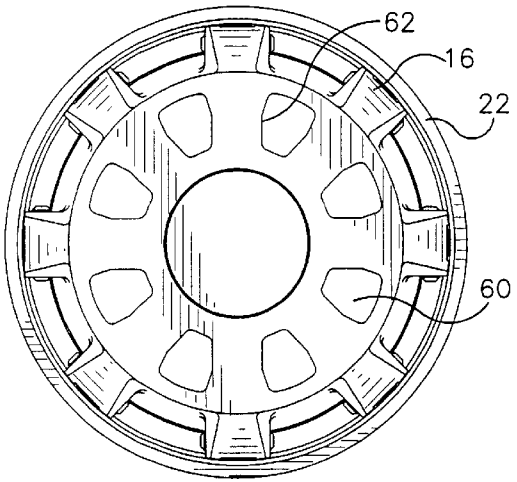
FIG. 3 is a view to looking in the direction of arrows 3—3 of FIG. 2.

The rear end face of the boot 66 is closed by a circular end plate 74 (FIGS. 1 and 2). This plate is welded around its perimeter to the trailing edge of the boot 66. The plate 76 includes holes 78 aligned with the cavities inside the base. The holes 78 are used to fill the cavities 60 (FIG. 3) with filler material, and they are then plugged with set- screws or the like. The end plate 76 falls away with the rest of the boot 66, exposing the end of the nozzle 18 through which exhaust gases from the propellant carried in body of the projectile may escape.

Thus it is clear that the present invention provides, in a projectile 10 with extensible fins 24 that is to be shot from a gun, a method and apparatus for packaging and protecting the fins 24 from destructive shock waves produced by the charge that fires the projectile, and for making the mounting structure for the fins as light as possible while protecting it from the same destructive shock waves.

What is claimed:

1. A projectile to be shot from the barrel of a gun by a charge, the projectile including a base, fins pivotably mounted to the base, weight reducing voids formed in the base and an incompressible filler material in the voids that limits propagation of shock waves in and around the base as the charge is setoff.

2. The projectile of claim 1 including a frangible boot surrounding the base and the filler material.

3. The projectile of claim 2 where in the filler material is semi-solid, and the boot supports the filler material around the base portion.

4. The projectile of claim 3 wherein the boot includes axially extending grooves to enhance its frangibility.

5. The projectile of claim 1 wherein the filler material is non-metallic and the base is metallic.

6. The projectile of claim 1 wherein the filler material is selected from the group comprising petroleum based semi-solids, silicones, waxes and epoxies.

7. The projectile of claim 1 wherein at least part of the filler material is bonded to the base.

8. The projectile of claim 7 wherein at least a part of the filler material separates from the projectile when the projectile leaves the gun barrel.

9. The projectile of claim 1 wherein the filler material separates from the projectile when the projectile leaves the gun barrel.

10. The projectile of claim 1 further including an obturator at the forward end of the base.

11. A method of protecting extensible fins of a projectile as it is fired by a charge from the barrel of a gun, the method including the steps of providing a projectile having a base with fin receiving slots and extensible fins mounted in to the base in the slots, and filling the slots with a non-metallic, substantially incompressible filler material.

12. The method of claim 11 further including the step of surrounding the filler material with a frangible material to protect the filler as it is loaded into the gun.

13. The method of claim 11 where the step of filling includes the step of filling with a filler material selected from the group including petroleum based semi-solids, silicones, waxes and epoxies.

14. The method of claim 11 wherein the base includes internal passages and the step of filling includes filling the passage with filler material.

15. The method of claim 14 wherein the step of filling the passages includes filling the passages at least partially with an incompressible filler material that bonds to the base.

16. The method of claim 15 further including the step of filling any part of the passages not filled with filler that bonds with a filler that does not bond.

* * * * *